United States Patent [19]

Fischer et al.

[11] Patent Number: 5,012,735

[45] Date of Patent: May 7, 1991

[54] WEB-FED ROTARY PRINTING MACHINE WITH ONE PRINTING COUPLE FOR FLYING PLATE CHANGE

[75] Inventors: Christian M. M. Fischer, Marktheidenfeld; Helmut Holm, Erlabrunn, both of Fed. Rep. of Germany

[73] Assignee: Koenig & Bauer Aktiengesellschaft, Wurzburg, Fed. Rep. of Germany

[21] Appl. No.: 379,813

[22] Filed: Jul. 14, 1989

[30] Foreign Application Priority Data

Jul. 23, 1988 [DE] Fed. Rep. of Germany ..... 3825145

[51] Int. Cl.[5] ..... B41F 5/06; B41F 5/22; B41F 7/12

[52] U.S. Cl. ..... 101/177; 101/180

[58] Field of Search ..... 101/177, 220, 221, 217, 101/247, 180, 181, 182, 185, 137, 138, 139, 140, 142, 143, 144, 145, 223, 224

[56] References Cited

U.S. PATENT DOCUMENTS 2,444,547 7/1948 Whitehead ..... 101/221

FOREIGN PATENT DOCUMENTS 3510823 9/1986 Fed. Rep. of Germany .

*Primary Examiner*—J. Reed Fisher

*Attorney, Agent, or Firm*—Jones, Tullar & Cooper

[57] ABSTRACT

A web-fed rotary printing assembly includes first and second printing couples. Each printing couple has upper and lower printing pairs of plate cylinders and blanket cylinders. An impression cylinder is pivotably supported cooperatively with the blanket cylinder of the first printing couple. Each of the blanket cylinders is also pivotably supported. This assembly allows the press to perform perfecting as well as being suitable as an imprinter. Flying plate changes may also be accomplished.

10 Claims, 4 Drawing Sheets

WEB-FED ROTARY PRINTING MACHINE WITH ONE PRINTING COUPLE FOR FLYING PLATE CHANGE

FIELD OF THE INVENTION

The present invention is directed generally to a web-fed rotary printing machine. More particularly, the present invention is directed to a web-fed offset rotary printing machine with several printing couples arranged successively. Most specifically, the present invention is directed to a web-fed offset rotary printing machine having a printing unit suitable for perfecting as well as for recto printing with a flying plate change. First and second printing couples, which each include upper and lower plate and blanket cylinder pairs are situated successively along the path of travel of a printing carrier web. The first printing couple has both upper and lower shiftable blanket cylinders and these cylinders are selectively engageable with an impression cylinder that is, in turn, shiftable between two positions. This arrangement allow recto and verso printing as well as recto printing with a flying plate change.

DESCRIPTION OF THE PRIOR ART

A printing assembly having a printing couple that is useable while allowing a flying plate change is shown in German Pat. No. 3,510,823. In this prior art device, one pair of plate cylinder and blanket cylinder can be stopped while the other pair of plate cylinder and blanket cylinder is brought into contact with a common rotating impression cylinder. During normal perfecting operation of this prior art printing assembly, the impression cylinder serves as an idler roller. This prior art impression cylinder is not movable.

In this prior art device, since the impression cylinder is fixed, it is not possible to pivot this roller out of the patch of the paper web. If the freshly printed web is deviated from its prepared path of travel, several well-known difficulties are apt to arise. The freshly printed image is apt to smear and this clearly results in a reduction of the quality of the printed product. A second difficulty is a set-off on the idling roller which corresponds to the impression cylinder of the German Pat. No. 3,510,823 discussed above. This set-off on the impression cylinder requires a regular cleaning and thus causes lost and hence non-productive time. In a particularly disadvantageous situation, this contact of the freshly printed carrier web can result in a doubling of the printed image.

These various difficulties, which may result when prior art devices are utilized, tend to reduce print quality and give rise to press downtime. Thus it will be seen that there is a need for a web-fed rotary printing machine with one printing couple that is useable as an imprinter and which includes a flying plate change capability. The web-fed rotary printing machine in accordance with the present invention provides such a device.

SUMMARY OF THE INVENTION

It is an object of the present invention to provide a web-fed rotary printing machine with one printing couple for flying plate changes.

Another object of the present invention is to provide a web-fed rotary offset printing machine with several printing couples for perfecting.

A further object of the present invention is to provide a web-fed rotary printing machine in which at lest one printing couple can be used as an imprinter with a flying plate change.

Yet another object of the present invention is to provide a web-fed rotary printing machine having a first printing coupled with upper and lower plate and blanket cylinders and a shiftable impression cylinder.

Even still a further object of the present invention is to provide a web-fed rotary printing machine useable as an imprinter in such a way that the printing carrier web printed by the imprinter in perfecting reaches a successive printing couple without further contact of the printing carrier web.

As will be discussed in detail in the description of the preferred embodiment, which is set forth subsequently, the web-fed rotary printing machine in accordance with the present invention utilizes first and second printing couples which are sequentially arranged along a path of travel of a printing carrier web. Each of these printing couples includes an upper plate cylinder and blanket cylinder pair and a lower plate cylinder and blanket cylinder pair. The upper blanket cylinder in the first printing couple is shiftable between two positions while the lower blanket cylinder is shiftable amount three positions. This first printing couple also includes an impression cylinder that is movable into and out of contact with at least the three position blanket cylinder. This first printing couple may be used in perfecting with the impression cylinder shifted out of contact, or in imprinter operation with the impression cylinder in contact with the lower blanket cylinder. The printing carrier web can be applied with ink in a recto and verso manner and the printing unit is appropriate for perfecting as well as for recto printing with a flying plate change.

A primary advantage of the web-fed rotary printing machine of the present invention is that the printing unit provided for the flying plate change can be used as a full printing unit with no loss of printing quality. The printing carrier web can be directed in one of several paths with respect to the first printing couple and its associated impression cylinder. Due to the shiftability of the blanket cylinders and the impression cylinder, various printing procedues, such as perfecting and imprinting, can be accomplished with no loss of printing quality. After the web has been freshly printed, it can be directed onto the next printing couple without being brought into contact with a fixed idler roller or the like.

In the rotary printing machine of the present invention, the two blanket cylinders or the first printing couple are sized to have a double-sized circumference. This sizing creates a favorable geometric relationship for the pivoting way of the impression cylinder so that there is only a small pivoting way of the impression cylinder between its waiting and working positions.

It will be seen that the web-fed rotary printing machine with one printing couple for flying plate change, in accordance with the present invention, provides an assembly which has substantial operating flexability with no loss of print quality. The present invention thus represents a significant advance in the art.

BRIEF DESCRIPTION OF THE DRAWINGS

While the novel features of the web-fed rotary printing machine with one printing couple for flying plate change in accordance with the present invention are set forth with particularity in the appended claims, a full and complete understanding of the invention may be had by referring to the detailed description of the preferred embodiment as is presented subsequently, and as illustrated in the accompanying drawings, in which:

DESCRIPTION OF THE PREFERRED EMBODIMENT

Figure 1:
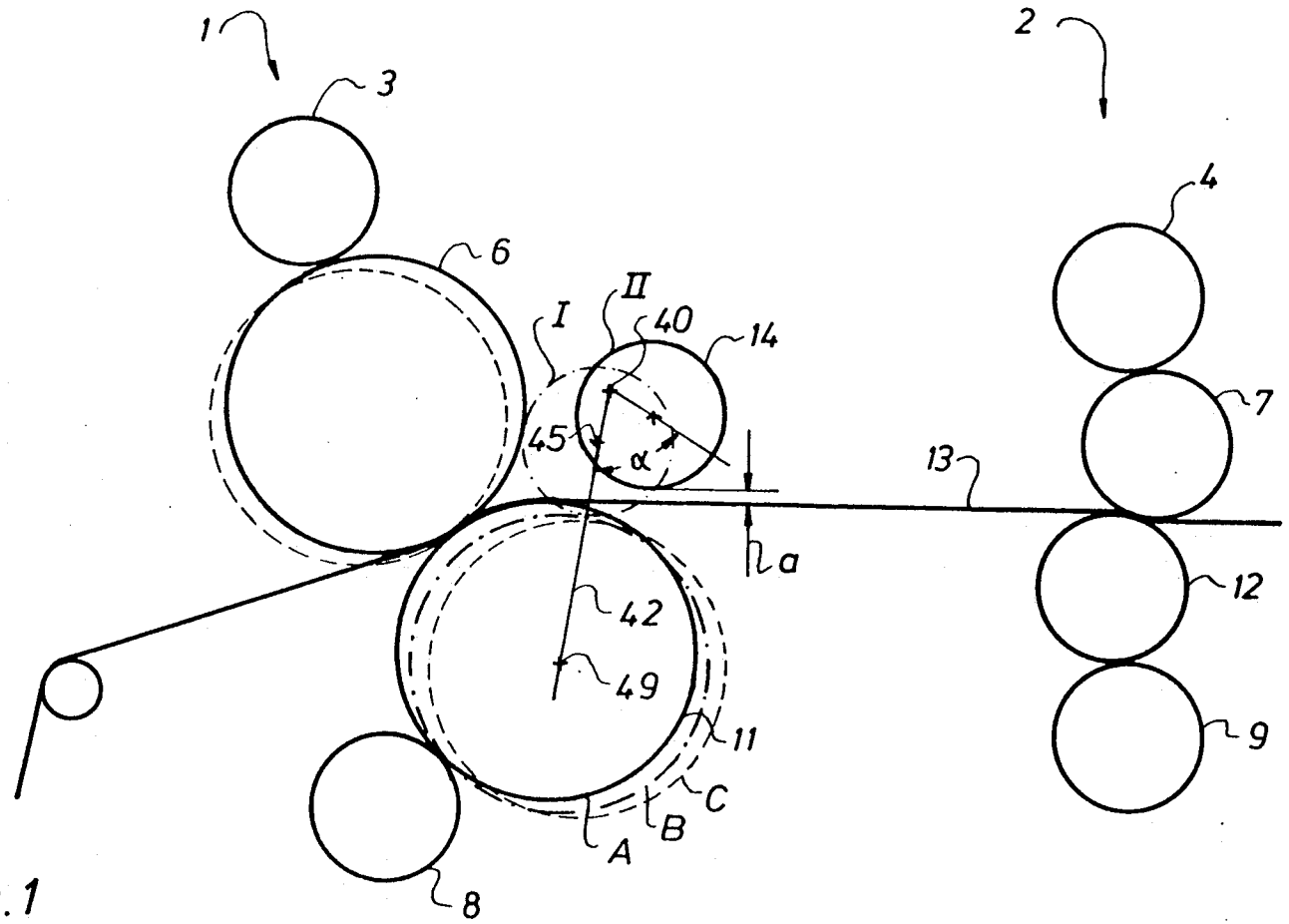
FIG. 1 is a schematic side elevation view of the present invention with the printing coupled positioned for perfecting.

Referring initially to FIG. 1, there may be seen a schematic depiction of a portion of a web-fed rotary printing machine with one printing coupled for a flying plate change in accordance with the present invention. A first printing couple is identified generally at 1 and a second, subsequent printing coupe is seen generally at 2. First printing coupled 1 and second printing couple 2 are utilized for perfecting of a printing carrier web generally at 13. It will be understood that these printing couples are depicted here without their associated inking and dampening units for the sake of clarity.

The first printing couple 1 includes an upper plate cylinder 3, an upper blanket cylinder 6, and a lower plate cylinder 8 and a lower blanket cylinder 11. Second printing coupled includes an upper plate cylinder 4, an upper blanket cylinder 7, and a lower plate cylinder 9 and a lower blanket cylinder 12. The blanket cylinders 6 and 11 of the first printing couple have a double-sized circumference in comparison to the other cylinders. First printing couple 1 is, in accordance with the present invention disposed as an imprinter with a flying plate change capability and further includes a pivotable impression cylinder 11 subsequent, in the direction of travel of printing carrier web 13, to the upper and lower blanket cylinders 6 and 11.

When the first printing coupled 1 is in its imprinter operation mode, the impression cylinder 14 can alternatively be brought into contact with either blanket cylinder 6, blanket cylinder 11 or with both of these blanket cylinders. For this purpose, the impression cylinder 14 is pivotably arranged in a first or imprinter working position I, as seen in dot-dash lines in FIG. 1. When the first printing couple 1 is operating in its perfecting mode of operation, the impression cylinder 14 is pivotably arranged in a second or waiting position II as shown in solid lines in FIG. 1.

Figure 2:
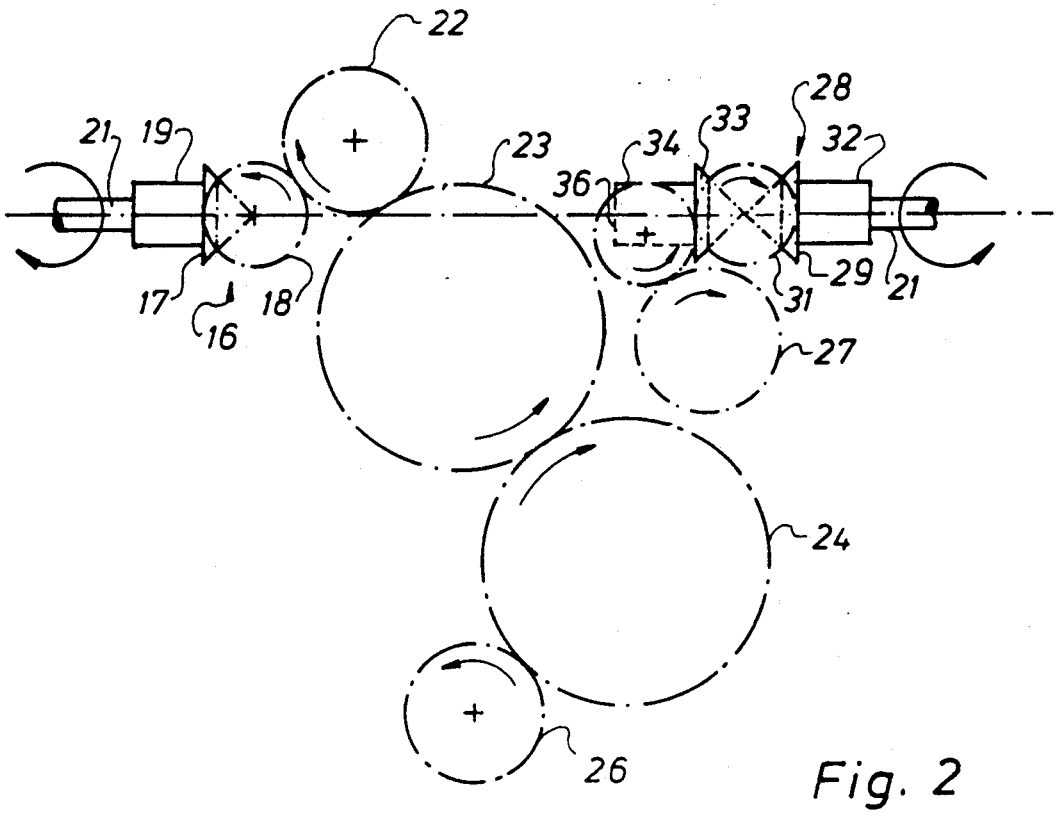
FIG. 2 is a schematic side elevation view of the gear train for the imprinter on the operating side.
Figure 3:
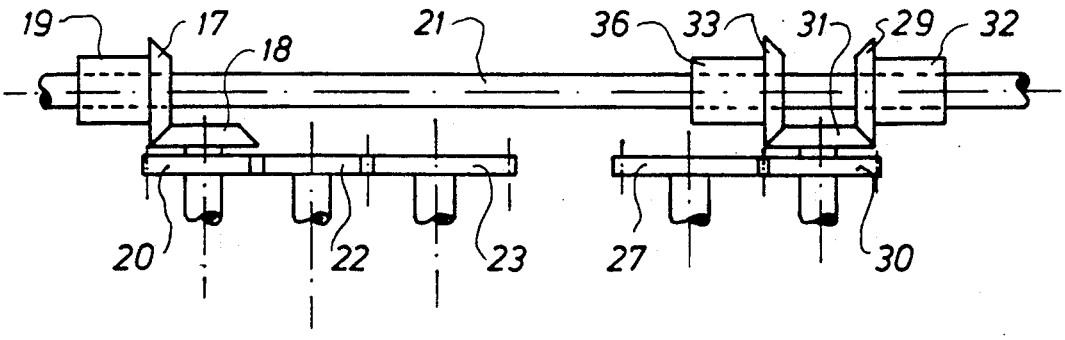
FIG. 3 is a top plan view of the gear train shown in FIG. 2.

A driving gear train for the various cylinders in each of the printing couples 1 and 2 is arranged on one side of each printing couple. In the perfecting mode, the drive on the first printing couple is effected through a first bevel gearing train 16. Perfecting means that the upper pair of plate cylinder 3 and blanket cylinder 6 stand in an "impression-on" position and the lower pair of plate cylinder 8 and blanket cylinder 11 stand in a first "impression-on" position. The bevel gearing arrangement 16, as seen in FIGS. 2 and 3, consists of a bevel gear 17 and a bevel gear 18. Bevel gear 17 is connected to a drive shaft 21 by means of an engageable clutch 19, such as an electromagnetic clutch. The bevel gear 18 is fixedly connected to a spur gear 20, and this spur gear 20 meshes with a gear 22 of the plate cylinder 3. Gear 22, in turn, meshes with a gear 23 of the blanket cylinder 6. The gear 23 further meshes with a gear 24 of the blanket cylinder 11 and this gear 24 meshes with a gear 26 of the plate cylinder 8. A gear 27 of the impression cylinder 14 is not meshing with the gears 23 and 24 of the blanket cylinders 6 and 11, all of which is depicted in FIG. 2.

While the various cylinders of the first printing couple are changed from the perfecting mode, as discussed above, and are placed in their imprinter mode, the drive gearing is similarly changed. In this position of the cylinders for the imprinter mode, the drive of the printing mode 1 is effected by a second bevel gearing train 28. Concurrently, the drive connection between main drive shaft 21 and first bevel gearing train 16 is separated by means of clutch 19. The second bevel gearing train 28 includes a first bevel gear 29 and a cooperating second bevel gear 31 and is connected to the main drive shaft 21, for a first printing carrier web-lead, as depicted by the continuous line in FIG. 5, by means of an engageable first clutch 32 which may be an electromagnetic clutch. The bevel gear 31 is fixedly connected with a spur gear 30. This gear 30 meshes with an intermediate wheel 34 which meshes with the gear 27 of the impression cylinder 14. In the "impression-on" position A of the first pair of plate cylinder 3 and blanket cylinder 6, and in the "impression-off" position C of the second pair of plate cylinder 8 and blanket cylinder 11, the gear 27 meshes with the gear 23 of the blanket cylinder 6.

In a second "impression-on" position B of the second pair of plate cylinder B and blanket cylinder 11, and an "impression-off" position of the first pair of plate cylinder 3 and blanket cylinder 11 and this meshes with the gear 26 of the plate cylinder 8 while the gear 24 of the blanket cylinder 11 remains not in mesh with the gear 23 of the blanket cylinder 6. By meshing gear 27 and gear 24, the second pair of plate cylinder 8 and blanket cylinder 11 is driven in the required reverse direction of rotation.

Figure 5:
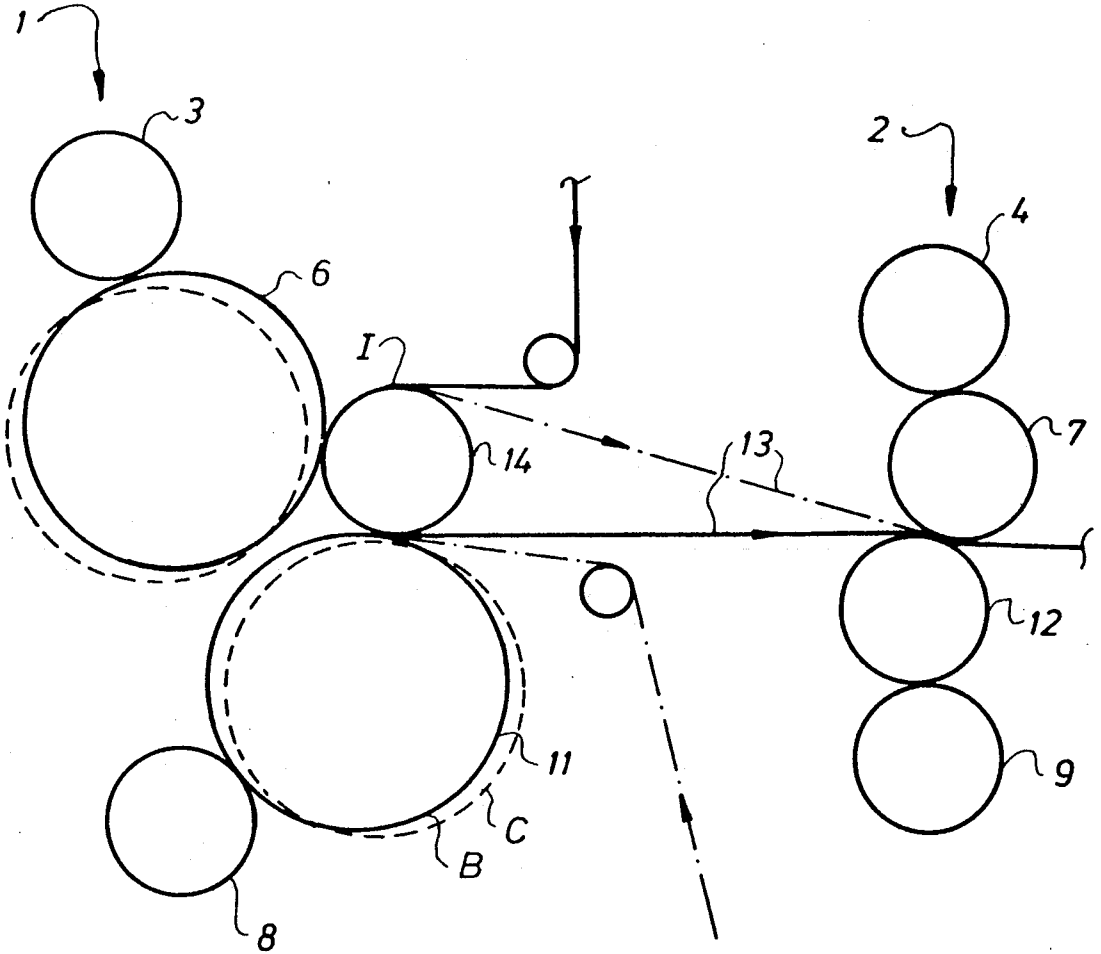
FIG. 5 is a schematic side elevation view of the present invention and showing printing carrier web leads during flying plate change or recto printing.

To provide a second printing carrier web-lead as shown by the dot-dash-line in FIG. 5, a change-over of the direction of rotation of the impression cylinder 14 is required. To accomplish this, the drive of the bevel gear 31 is effected by a third bevel gear 33 of the second gear train 28. The third bevel gear 33 is connectable with the drive shaft 21 by means of a second engageable clutch 36. The drive shaft 21 is led through all the bevel gears 17, 29 33.

This second engageable clutch 36, which is also part of the second gear train 28, is engageable to connect the third bevel gear 33 to the common drive shaft 21 which passes through all of the clutch controlled bevel gears 17, 29 and 33. It will, of course be understood that each of the engageable clutches 19, 32 and 36 is individually operable.

Each of the individual plate, blanket and impression cylinders if rotatably supported in conventional side frames of the web-fed rotary printing machine. Since these side frames are of a conventional nature, they are not shown. The several plate cylinders 3, 4, 8 and 9 are rotatably but not pivotably supported in the side frames in a conventional manner. The blanket cylinders 6, 7 and 12 are each pivotably supported by eccentric bushing arrangements so that they can each be moved between "impression-on" and "impression-off" positions. The eccentric bushings each are arranged in such a way that the gears of the blanket cylinders 6, 7 and 12 in "impression-off" position C remain in mesh with the gears of the plate cylinders 3, 4 and 9, thus maintaining a drive between the representative pairs of plate cylinder and blanket cylinder.

Figure 4:
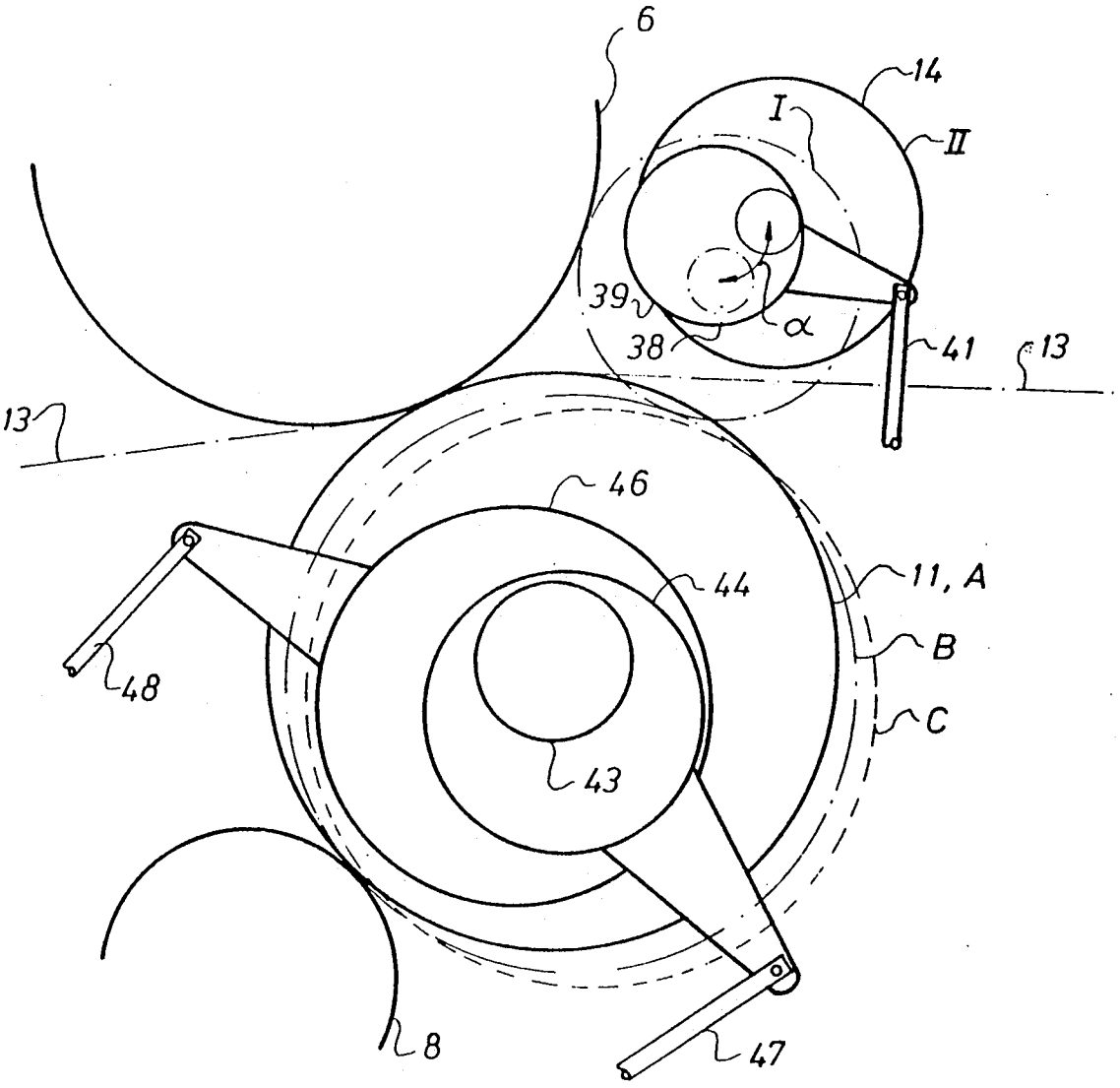
FIG. 4 is a schematic side elevation view of a portion of the first printing couple and showing an adjustment device for the lower blanket cylinder and the impression cylinder.

The impression cylinder 14 is supported by shaft journals 38 in an eccentric bush 39 within the side frames, as seen in FIG. 4. For adjusting the eccentric bush 39, an adjusting element, not specifically represented, acts on a linkage 41. By pivoting the eccentric bush 39, the impression cylinder 14 may be pivoted between the waiting position II, which it has in perfecting, and the working position I, which is had during flying plate change (1/0, 1/0) or double, recto printing (2/0 0/2). In order to bring the impression cylinder 14 out of its working position I and int its waiting position II, the eccentric bush 39 may be rotated through a pivoting angle $\alpha$ of approximately 35°. Depending on the size of the eccentric support of the impression cylinder 14 the pivoting angle $\alpha$ may be between 25°–90°. This pivoting angle is defined as the angle through which the impression cylinder 14 must be pivoted out of an "impression-on" position with the blanket cylinder (position B) so that the impression cylinder 14 attains a sufficiently high spacing "a" from the printing carrier web 13. A center of rotation 40 of the eccentric bush 39 is positioned on an imaginary starting line 42, which in the "impression-on" position of the impression cylinder 14 with the blanket cylinder 11, cuts the centers of rotation 45 and 49 of the impression cylinder 14 and of the blanket cylinder 11 at a right angle. In the waiting position II, the impression cylinder 14 is pivoted away from both blanket cylinders 3 and 6 and stands in the waiting position II at distance "a" out of contact with the printing carrier web 13. This distance "a" is approximately 1–5 mm from the printing carrier web 13. The drive for the impression cylinder 14 is stopped by disengaging the clutches 32 and 34.

The blanket cylinder 11 is supported by means of roller journals 43 in a first eccentric bush 44 and this first eccentric bush 44 is, in turn, supported in a second eccentric bush 46. Due to this double eccentric support, the blanket cylinder 11 is pivotable into three final positions A, B and C by means of adjusting elements (not represented) acting on the eccentric bushes 44 and 46 via linkage 47 and 48, respectively, as may be seen in FIG. 4. The adjusting elements can be hydraulic or pneumatic cylinders, but other driving types are also possible. In the final position A, depicted with a continuous line, in FIGS. 1 and 4, the blanket cylinder 11 is in a first "impression-on" position with the blanket cylinder 6 and is in contact with the plate cylinder 8. In the final position B, depicted with a dot-dash-line, the blanket cylinder 11 is in a second "impression-on" position with the impression cylinder 14 when the impression cylinder 14 is in the working position I and is also in contact with the plate cylinder 8. The blanket cylinders 6 and 11 then have no contact. In the final position C, also referred to as the "impression-off" position, marked with a dashed line, the blanket cylinder 11 has no contact with the blanket cylinder 6, the impression cylinder 14 and the plate cylinder 8. The drive of the impression cylinder is then interrupted.

Each of the blanket cylinders 6 and 11 is also provided with its own accelerating drive means. These accelerating drive means, which are used to return the rotational speeds of the blanket cylinders 6 and 11, and hence the plate cylinders 3 and 8 to the same speed as the rest of the printing machine, as would be required after one of these printing couples had been stopped to effect a flying plate change, form no part of the subject patent application and are thus not discussed in detail. Each of these accelerating drives for each of the blanket cylinders 6 and 11 may be an electric or hydraulic drive or the like. After each printing pair has been stopped for a flying plate change and while it is still in its "impression-off" or waiting position, the accelerating drive means will be used to bring the blanket cylinder 6 or 11 and its associated plate cylinder 3 or 8 up to synchronous speed. Once this has been done, the blanket cylinder 6 or 11 can be moved into its "impression-on" position. In this position, the blanket cylinder's drive gear 23 or 24 will mesh with the impression cylinder gear 27. Once this has been done, the accelerating drive can be shut off.

While a preferred embodiment of a web-fed rotary printing machine with one printing couple for flying plate change in accordance with the present invention has been fully and completely set forth hereinabove, it will be apparent that various changes in, for example the types of printing plates used, the specific accelerating drive means, the particular sizes of the cylinders and the like could be made without departing from the true spirit and scope of the subject application which is accordingly to be limited only by the following claims.

What is claimed is:

1. A web-fed rotary offset printing machine selectively useable for perfecting and imprinting with a flying plate change, said printing machine comprising:

first and second rotary printing couples situated successively along a path of travel of a printing carrier web, each said first and second printing couples being useable to apply ink to a printing carrier web;

a first plate cylinder and a first cooperating blanket cylinder and a second plate cylinder and a second cooperating blanket cylinder in each said first and second printing couples, said first and second blanket cylinders in each said first and second printing couples being concurrently engageable with a printing carrier web during perfecting;

an impression cylinder for said first printing couple;

means for stopping rotation of said first plate cylinder and said cooperating first blanket cylinder of said first printing couple to effect a flying plate change on said first printing couple; means for effecting contact between said second blanket bylinder and said impression cylinder during said flying plate change; and means for supporting said impression cylinder for pivotable movement between a working position in contact with a printing carrier web during said flying plate change and a waiting position out of contact with a printing web carrier during perfecting.

2. The web-fed rotary offset printing machine of claim 1 wherein said first and second blanket cylinders of said first printing couple each have a first circumferential size which is twice that of a second circumferential size of said first and second plate cylinders of said first printing couple.

3. The web-fed rotary offset printing machine of claim 1 wherein said second blanket cylinder of said first printing couple is supported for pivotal movement among first, second, and third positions.

4. The web-fed rotary printing offset printing machine of claim 3 further including first adjusting means for pivotably moving said impression cylinder between said working position and said waiting position, and second adjusting means for pivotably moving said second blanket cylinder of said first printing couple among said first, second, and third position.

5. The web-fed rotary offset printing machine of claim 4 wherein said first adjusting means and said second adjusting means each includes at least a first eccentric bushing.

6. The web-fed rotary offset printing machine of claim 1 wherein said impression cylinder is pivotably movable through a pivoting angle between said working position and said waiting position.

7. The web-fed rotary printing machine of claim 1 further including a drive shaft for driving a first gear train to effect rotation of said cylinders of said first printing couple during perfecting, and a clutch useable to selectively connect said first gear train with said drive shaft.

8. The web-fed rotary offset printing machine of claim 1 further including a drive shaft for driving a first gear train to effect rotation of said cylinders to said first printing couple in a first direction and means for selectively reversing said direction of rotation of said cylinders of said first printing couple.

9. The web-fed rotary offset printing machine of claim 8 wherein said reversing means includes an electromagnetic clutch useable to selectively connect said first gear train with said drive shaft and spaced bevel gear drives connected to said clutch.

10. The web-fed rotary offset printing machine of claim 5 wherein a center of rotation for said eccentric bushing of said first adjusting means is located on a straight line which passes through a center of rotation of said impression cylinder and a center of rotation of said second blanket cylinder of said first printing couple when said impression cylinder is in said working position.

* * * * *